US005940667A

United States Patent [19]

Folkins

[11] Patent Number: 5,940,667

[45] Date of Patent: Aug. 17, 1999

[54] ASYMMETRICAL DONOR MEMBER VOLTAGE

[75] Inventor: Jeffrey J. Folkins, Rochester, N.Y.

[73] Assignee: Xerox Corporation, Stamford, Conn.

[21] Appl. No.: 09/165,388

[22] Filed: Oct. 2, 1998

[51] Int. Cl.[6] ..... G03G 15/08

[52] U.S. Cl. ..... 399/266; 399/291

[58] Field of Search ..... 399/266, 279, 399/290, 291

[56] References Cited

U.S. PATENT DOCUMENTS

| | | | |
|---|---|---|---|
| 4,102,305 | 7/1978 | Schwarz | 118/651 |
| 4,565,438 | 1/1986 | Folkins | 355/3 DD |
| 4,868,600 | 9/1989 | Hays et al. | 355/259 |
| 5,144,371 | 9/1992 | Hays . | |
| 5,204,719 | 4/1993 | Bares . | |
| 5,206,693 | 4/1993 | Folkins . | |
| 5,404,208 | 4/1995 | Edmunds . | |
| 5,666,619 | 9/1997 | Hart et al. | 399/266 |
| 5,758,239 | 5/1998 | Matalevich | 399/266 |

*Primary Examiner*—Richard Moses
*Attorney, Agent, or Firm*—Lloyd F. Bean, II

[57] ABSTRACT

The present invention is an apparatus that develops a latent image recorded on a surface with toner. An electrically biased electrode member in the development zone between the photoconductive member and the donor roll detaches toners from the donor roll so as to form a toner powder cloud in the development zone. The electrical bias applied on the donor member is an asymmetrical wave. Toner from the toner powder cloud develops the latent image.

4 Claims, 5 Drawing Sheets

ASYMMETRICAL DONOR MEMBER VOLTAGE

BACKGROUND OF THE INVENTION

This invention relates generally to the development of electrostatic images, and more particularly concerns a scavengeless development system in which an asymmetrical electrical bias is applied on the donor development roller.

The invention can be used in the art of color electrophotographic printing. Generally, the process of electrophotographic printing includes sensitizing a photoconductive surface by charging it to a substantially uniform potential. The charge is selectively dissipated in accordance with a pattern of activating radiation corresponding to a desired image. The selective dissipation of the charge leaves a latent charge pattern that is developed by bringing a developer material into contact therewith. This process forms a toner powder image on the photoconductive surface which is subsequently transferred to a copy sheet. Finally, the powder image is heated to permanently affix it to the copy sheet in image configuration. Two component and single component developer materials are commonly used. A typical two component developer material comprises magnetic carrier granules having toner particles adhering triboelectrically thereto. A single component developer material typically comprises toner particles having an electrostatic charge so that they will be attracted to, and adhere to, the latent image on the photoconductive surface. There are various known development systems for bringing toner particles to a latent image on a photoconductive surface. Single component development systems use a donor roll for transporting charged toner to the development nip defined by the donor roll and the photoconductive surface. In a scavengeless system the toner is developed on the latent image recorded on the photoconductive surface by the use of a donor roll with a plurality of electrode wires closely spaced therefrom in the development zone. An AC voltage is applied to the wires detaching the toner from the donor roll and forming a toner powder cloud in the development zone. The electrostatic fields generated by the latent image attract toner from the toner cloud to develop the latent image. In another type of scavengeless system called "hybrid scavengeless", a magnetic developer roll attracts developer from a reservoir. The developer includes carrier and toner. The toner is attracted from the carrier to a donor roll. The donor roll then carries the toner into proximity with the latent image.

The following disclosures may be relevant to various aspects of the present invention: U.S. Pat. No. 4,102,305. Patentee: Schwarz. Issued: Jul. 25, 1978. U.S. Pat. No. 4,565,438. Patentee: Folkins. Issued: Jan. 21, 1986. U.S. Pat. No. 4,868,600. Patentee: Hays et al. Issued: Sep. 19, 1989. U.S. patent application Ser. No. 07/563,026, (abandoned). Applicant: Floyd Jr. et al. Filed: Aug. 3, 1990. U.S. Pat. No. 5,206,693, Patentee Folkins, issued Apr. 27, 1993.

The relevant portions of the foregoing disclosures may be briefly summarized as follows: U.S. Pat. No. 4,102,305 describes a developer roll that is electrically biased with an AC voltage superimposed over a DC voltage. U.S. Pat. No. 4,565,438 discloses an asymmetrical alternating electrical bias applied on a developer roller. U.S. Pat. No. 4,868,600 describes a scavengeless development system in which toner is detached from a donor roll and a powder cloud obtained by AC electrically biased electrode wires. The donor roll is electrically biased by a DC voltage. U.S. patent application Ser. No. 07/563,026 (abandoned) describes a magnetic roll for transporting developer material from a reservoir to a donor roll and electrode wires that are electrically biased to detach toner from the donor roll so as to form a toner cloud in the development zone. U.S. Pat. No. 5,206,693 describes a scavengeless development system in which toner is detached from a donor roll and a powder cloud obtained by Asymmetrical AC electrically biased electrode wires. The application of the asymmetrical AC in this patent is to the electrode wires and the purpose of the asymmetry is to reduce the wire vibration or "strobing" defect.

The present invention utilizes an asymmetric AC on the donor roll rather than the electrode wires in order to modify the position and trajectories of the toner particles in the powder cloud by modifying the fields in the space between the donor roll and the photoreceptor. The purpose of this asymmetry is to improve the non-interactive performance of the powder cloud against disturbing already developed images on the photoreceptor.

BRIEF SUMMARY OF THE INVENTION

In accordance with one aspect of the present invention, there is provided an apparatus for developing a latent image recorded on a surface with toner. The apparatus includes means for transporting toner to a development zone adjacent the surface. An electrode member is disposed in the development zone. Means are provided for electrically biasing the electrode member with an electrical field to detach toner from the transporting means and produce a toner cloud in the development zone. Means are provided for electrically biasing the transporting means with an asymmetric electrical field to produce a toner cloud in the development zone with the proper characteristics of adequate toner development to the latent image but without excessive disturbance of any toner previously developed onto the latent image. Pursuant to another aspect of the present invention, there is provided an electrophotographic printing machine for developing a latent image recorded on a photoconductive surface with toner. The printing machine includes a means for transporting toner to a development zone adjacent the surface. An electrode member is disposed in the development zone. Means are provided for electrically biasing the electrode member with an electrical field to detach toner from the transporting means and produce a toner cloud in the development zone. Means are provided for electrically biasing the transporting means with an asymmetric electrical field to produce a toner cloud in the development zone with the proper characteristics of adequate toner development to the latent image but without excessive disturbance of any toner previously developed onto the latent image.

Other features of the present invention will become apparent as the following description proceeds and upon reference to the drawings.

Inasmuch as the art of electrophotographic printing is well known, the various processing stations employed in the printing machine will be shown hereinafter schematically and their operation described briefly with reference thereto.

DETAILED DESCRIPTION OF THE PRESENT INVENTION

Figure 1:
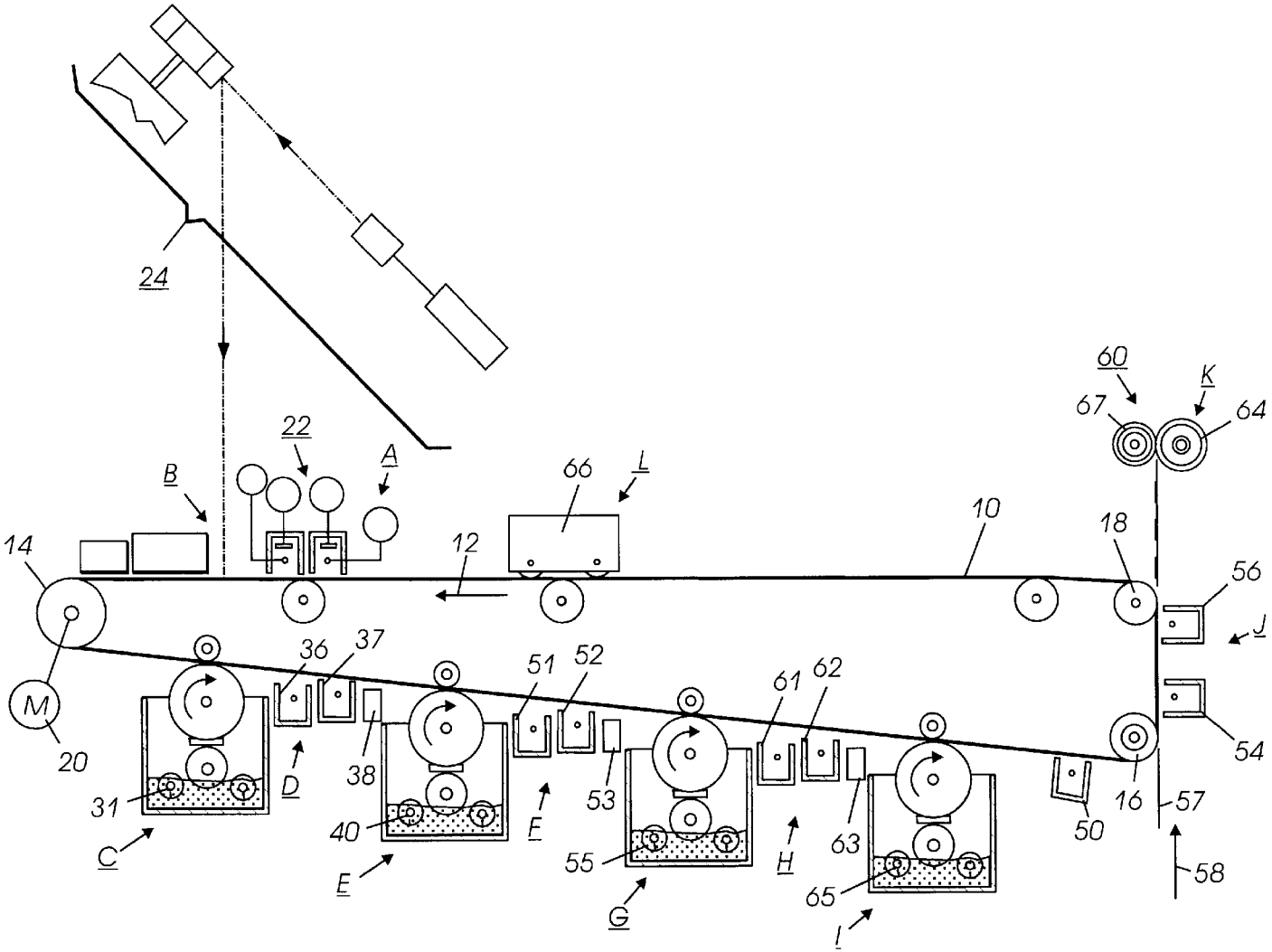
FIG. 1 is a schematic elevational view of an illustrative color electrophotographic printing or imaging machine or apparatus incorporating a development apparatus having the features of the present invention therein.

Referring initially to FIG. 1, there is shown an illustrative electrophotographic machine having incorporated therein the development apparatus of the present invention. An electrophotographic printing machine creates a color image in a single pass through the machine and incorporates the features of the present invention. The printing machine uses a charge retentive surface in the form of an Active Matrix (AMAT) photoreceptor belt 10 which travels sequentially through various process stations in the direction indicated by the arrow 12. Belt travel is brought about by mounting the belt about a drive roller 14 and two tension rollers 16 and 18 and then rotating the drive roller 14 via a drive motor 20.

As the photoreceptor belt moves, each part of it passes through each of the subsequently described process stations. For convenience, a single section of the photoreceptor belt, referred to as the image area, is identified. The image area is that part of the photoreceptor belt which is to receive the toner powder images that, after being transferred to a substrate, produce the final image. While the photoreceptor belt may have numerous image areas, since each image area is processed in the same way, a description of the typical processing of one image area suffices to fully explain the operation of the printing machine.

Figure 2:
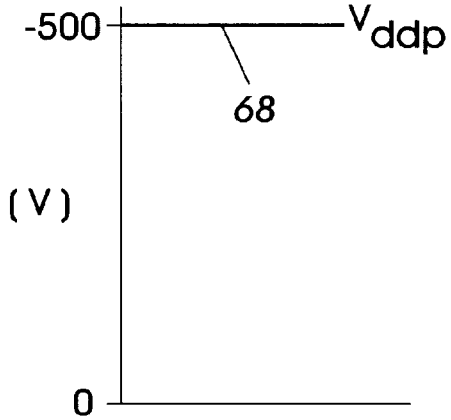
FIG. 2 shows a typical voltage profile of an image area in the electrophotographic printing machines illustrated in FIG. 1 after that image area has been charged.

As the photoreceptor belt 10 moves, the image area passes through a charging station A. At charging station A, a corona generating device, indicated generally by the reference numeral 22, charges the image area to a relatively high and substantially uniform potential. FIG. 2 illustrates a typical voltage profile 68 of an image area after that image area has left the charging station A. As shown, the image area has a uniform potential of about −500 volts. In practice, this is accomplished by charging the image area slightly more negative than −500 volts so that any resulting dark decay reduces the voltage to the desired −500 volts. While FIG. 2 shows the image area as being negatively charged, it could be positively charged if the charge levels and polarities of the toners, recharging devices, photoreceptor, and other relevant regions or devices are appropriately changed.

Figure 3:
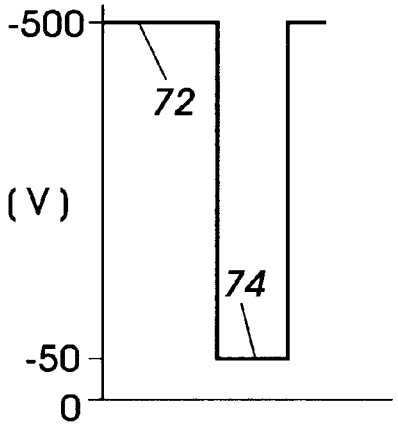
FIG. 3 shows a typical voltage profile of the image area after being exposed.

After passing through the charging station A, the now charged image area passes through a first exposure station B. At exposure station B, the charged image area is exposed to light which illuminates the image area with a light representation of a first color (say black) image. That light representation discharges some parts of the image area so as to create an electrostatic latent image. While the illustrated embodiment uses a laser-based output scanning device 24 as a light source, it is to be understood that other light sources, for example an LED printbar, can also be used with the principles of the present invention. FIG. 3 shows typical voltage levels, the levels 72 and 74, which might exist on the image area after exposure. The voltage level 72, about −500 volts, exists on those parts of the image area which were not illuminated, while the voltage level 74, about −50 volts, exists on those parts which were illuminated. Thus after exposure, the image area has a voltage profile comprised of relative high and low voltages.

After passing through the first exposure station B, the now exposed image area passes through a first development station C which is identical in structure with development system E, G, and I. The first development station C deposits a first color, say black, of negatively charged toner 31 onto the image area. That toner is attracted to the less negative sections of the image area and repelled by the more negative sections. The result is a first toner powder image on the image area. It should be understood that one could also use positively charged toner if the exposed and unexposed areas of the photoreceptor are interchanged, or if the charging polarity of the photoreceptor is made positive.

Figure 8:
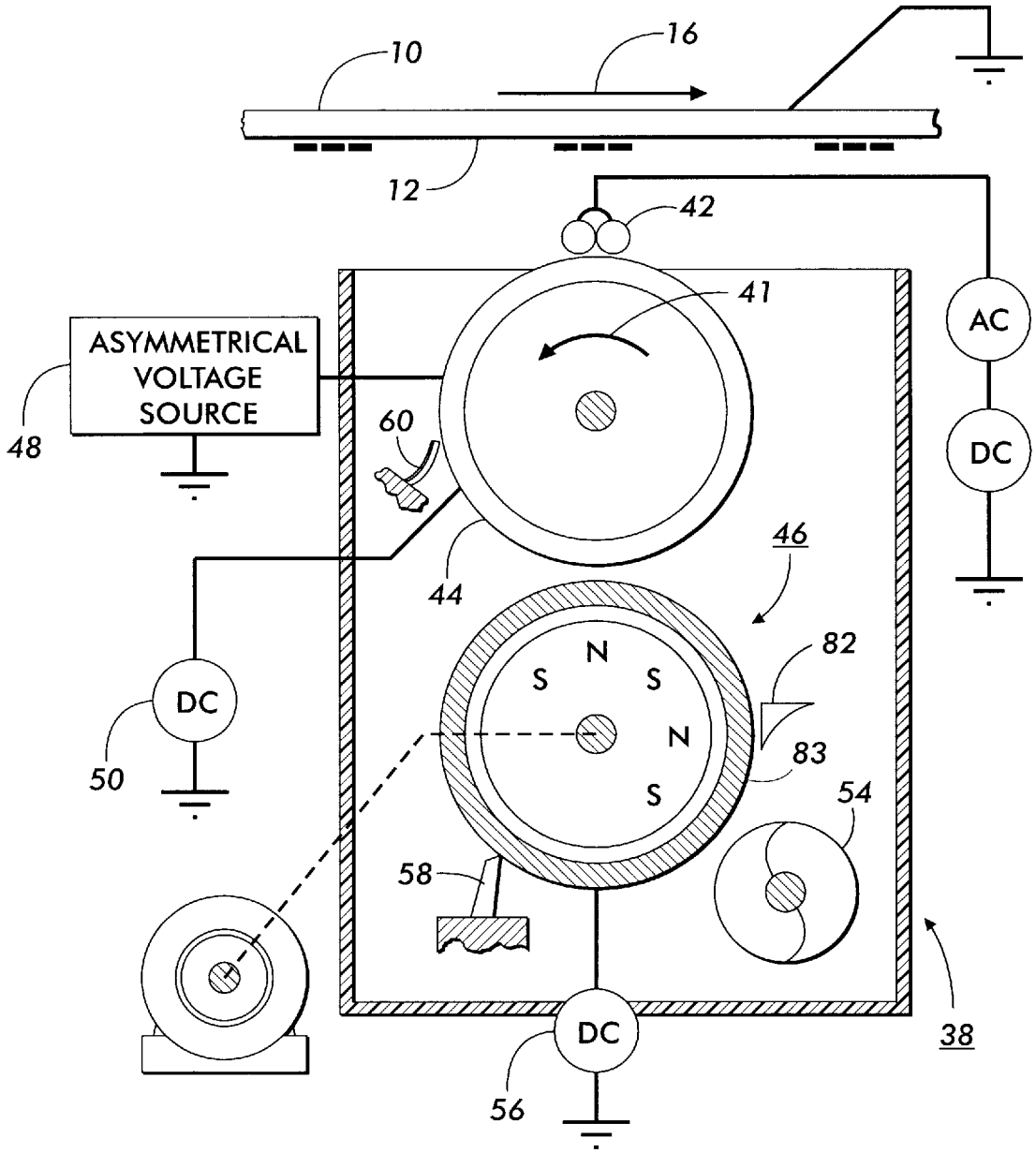
FIG. 8 is a schematic elevational view showing the development apparatus used in the FIG. 1 printing machine.

For the first development station C, development system includes a donor roll. As illustrated in FIG. 8, electrode grid 42 is electrically biased with an AC voltage relative to donor roll 44 for the purpose of detaching toner therefrom. This detached toner forms a toner powder cloud in the gap between the donor roll and photoconductive surface. Both electrode grid 42 and donor roll 44 are biased with DC sources 102 and 92 respectively for discharge area development (DAD). The discharged photoreceptor image attracts toner particles from the toner powder cloud to form a toner powder image thereon.

Figure 4:
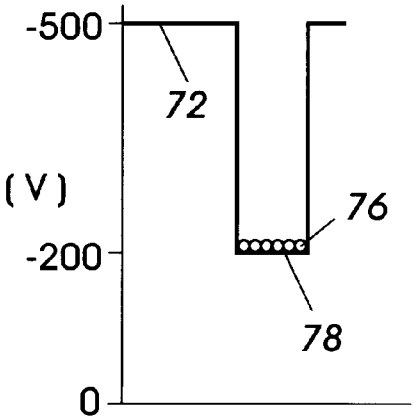
FIG. 4 shows a typical voltage profile of the image area after being developed.

FIG. 4 shows the voltages on the image area after the image area passes through the first development station C. Toner 76 (which generally represents any color of toner) adheres to the illuminated image area. This causes the voltage in the illuminated area to increase to, for example, about −200 volts, as represented by the solid line 78. The unilluminated parts of the image area remain at about the level −500 72.

Referring back to FIG. 1, after passing through the first development station C, the now exposed and toned image area passes to a first recharging station D. The recharging station D is comprised of two corona recharging devices, a first recharging device 36 and a second recharging device 37. These devices act together to recharge the voltage levels of both the toned and untoned parts of the image area to a substantially uniform level. It is to be understood that power supplies are coupled to the first and second recharging devices 36 and 37, and to any grid or other voltage control surface associated therewith, so that the necessary electrical inputs are available for the recharging devices to accomplish their task.

Figure 5:
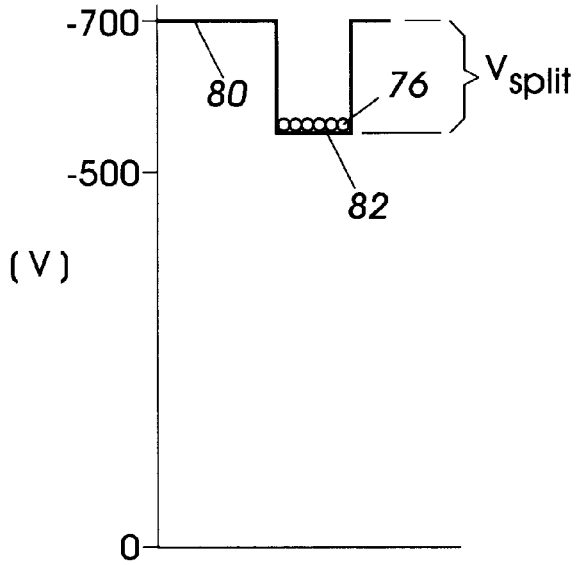
FIG. 5 shows a typical voltage profile of the image area after being recharged by a first recharging device.

FIG. 5 shows the voltages on the image area after it passes through the first recharging device 36. The first recharging device overcharges the image area to more negative levels than that which the image area is to have when it leaves the recharging station D. For example, as shown in FIG. 5 the toned and the untoned parts of the image area, reach a voltage level 80 of about −700 volts. The first recharging device 36 is preferably a DC scorotron.

Figure 6:
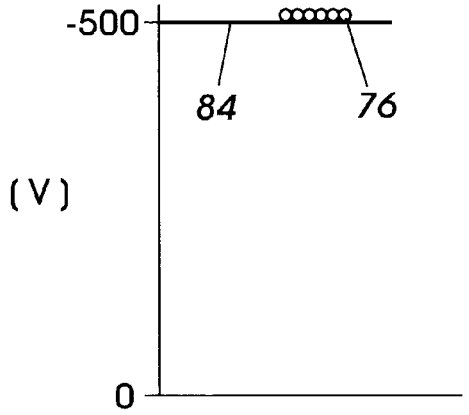
FIG. 6 shows a typical voltage profile of the image area after being recharged by a second recharging device.

After being recharged by the first recharging device 36, the image area passes to the second recharging device 37. Referring now to FIG. 6, the second recharging device 37 reduces the voltage of the image area, both the untoned parts and the toned parts (represented by toner 76) to a level 84 which is the desired potential of −500 volts.

Figure 7:
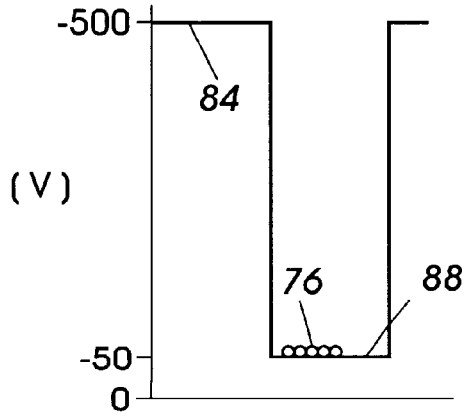
FIG. 7 shows a typical voltage profile of the image area after being exposed for a second time.

After being recharged at the first recharging station D, the now substantially uniformly charged image area with its first toner powder image passes to a second exposure station 38. Except for the fact that the second exposure station illuminates the image area with a light representation of a second color image (say yellow) to create a second electrostatic latent image, the second exposure station 38 is the same as the first exposure station B. FIG. 7 illustrates the potentials on the image area after it passes through the second exposure station. As shown, the non-illuminated areas have a potential about −500 as denoted by the level 84. However, illuminated areas, both the previously toned areas denoted by the toner 76 and the untoned areas are discharged to about −50 volts as denoted by the level 88.

The image area then passes to a second development station E. Except for the fact that the second development station E contains a toner 44 which is of a different color (yellow) than the toner 31 (black) in the first development station C, the second development station is substantially the same as the first development station. Since the toner 44 is attracted to the less negative parts of the image area and repelled by the more negative parts, after passing through the second development station E the image area has first and second toner powder images which may overlap.

The image area then passes to a second recharging station F. The second recharging station F has first and second recharging devices, the devices 51 and 83, respectively, which operate similar to the recharging devices 36 and 37. Briefly, the first corona recharge device 51 overcharges the image areas to a greater absolute potential than that ultimately desired (say −700 volts) and the second corona recharging device, comprised of coronodes having AC potentials, neutralizes that potential to that ultimately desired.

The now recharged image area then passes through a third exposure station 53. Except for the fact that the third exposure station illuminates the image area with a light representation of a third color image (say magenta) so as to create a third electrostatic latent image, the third exposure station 38 is the same as the first and second exposure stations B and 38. The third electrostatic latent image is then developed using a third color of toner 55 (magenta) contained in a third development station G.

The now recharged image area then passes through a third recharging station H. The third recharging station includes a pair of corona recharge devices 61 and 82 which adjust the voltage level of both the toned and untoned parts of the image area to a substantially uniform level in a manner similar to the corona recharging devices 36 and 37 and recharging devices 51 and 83.

After passing through the third recharging station the now recharged image area then passes through a fourth exposure station 63. Except for the fact that the fourth exposure station illuminates the image area with a light representation of a fourth color image (say cyan) so as to create a fourth electrostatic latent image, the fourth exposure station 63 is the same as the first, second, and third exposure stations, the exposure stations B, 38, and 53, respectively. The fourth electrostatic latent image is then developed using a fourth color toner 65 (cyan) contained in a fourth development station I.

To condition the toner for effective transfer to a substrate, the image area then passes to a pretransfer corotron member 50 which delivers corona charge to ensure that the toner particles are of the required charge level so as to ensure proper subsequent transfer.

After passing the corotron member 50, the four toner powder images are transferred from the image area onto a support sheet 57 at transfer station J. It is to be understood that the support sheet is advanced to the transfer station in the direction 58 by a conventional sheet feeding apparatus which is not shown. The transfer station J includes a transfer corona device 54 which sprays positive ions onto the backside of sheet 57. This causes the negatively charged toner powder images to move onto the support sheet 57. The transfer station J also includes a detack corona device 56 which facilitates the removal of the support sheet 83 from the printing machine.

After transfer, the support sheet 57 moves onto a conveyor (not shown) which advances that sheet to a fusing station K. The fusing station K includes a fuser assembly, indicated generally by the reference numeral 60, which permanently affixes the transferred powder image to the support sheet 57. Preferably, the fuser assembly 60 includes a heated fuser roller 67 and a backup or pressure roller 64. When the support sheet 57 passes between the fuser roller 67 and the backup roller 64 the toner powder is permanently affixed to the sheet support 57. After fusing, a chute, not shown, guides the support sheets 57 to a catch tray, also not shown, for removal by an operator.

After the support sheet 57 has separated from the photoreceptor belt 10, residual toner particles on the image area are removed at cleaning station L via a cleaning brush contained in a housing 66. The image area is then ready to begin a new marking cycle.

The various machine functions described above are generally managed and regulated by a controller which provides electrical command signals for controlling the operations described above.

It is believed that the foregoing description is sufficient for purposes of the present application to illustrate the general operation of an electrophotographic printing machine incorporating the development apparatus of the present invention therein.

Cc

Referring now to FIG. 8, there is shown one embodiment of the present invention in greater detail. The development system 38 includes a donor roll 44, electrode wires 42, and metering and charging roll 46. The donor roll 44 attracts toner from the reservoir and roll 46 charges the toner and meters the quantity on the donor roll. The donor roll 44 can be rotated in either the 'with' or 'against' direction relative to the direction of motion of belt 10. The donor roll is shown rotating in the direction of arrow 41. The metering and charging roll 46 may comprise any suitable device for metering and charging the toner. For example, it may comprise an apparatus such as described in U.S. Pat. No. 4,459,009 wherein the contact between weakly charged toner particles and a triboelectrically active coating contained on a charging roll results in well charged toner. Other combination metering and charging devices may also be employed.

The developer apparatus 38 further has electrode wires 42 located in the space between photoconductive surface 12 and donor roll 44, as described in U.S. Pat. No. 4,868,600. The electrode wires 42 include one or more thin tungsten wires which are lightly positioned against the donor roll 44. The distance between the wires 42 and the donor roll 44 is approximately the thickness of the toner layer on the donor roll 44. The extremities of the wires are supported by the tops of end bearing blocks (not shown) which also support the donor roll 44 for rotation. An alternating or AC electrical bias is applied to the electrode wires by an voltage source 48. The bias establishes an alternating electrostatic field between the wires 42 and the donor roll 44 which is effective in detaching toner from the surface of the donor roll 44 and forming a toner cloud about the wires 42, the height of the cloud being such as not to substantially contact with the photoconductive surface 12. An asymmetrical alternating or AC electrical bias is applied to the donor roll 44 in series with a DC potential. The purpose of an AC potential applied to donor roll 44 is to modify and stretch the cloud position so that it is closer to the photoconductor and accordingly so that the toners in the cloud are closer to and can more easily develop onto any fine detail of the latent image on the photoconductor. If the gap between the donor roll 44 and the photoconductor 10 is not sufficiently small then any small scale latent image on the photoconductor might not be adequately developed. This can result in insufficient image density on the resultant prints for fine lines and small font text. The application of an AC on the donor roll 44 serves to stretch the cloud and place the cloud toners closer to the photoconductor thus improving this fine structure development performance. Unfortunately a defect associated with both small gaps and large levels of donor AC is that of interactivity. In a color machine such as described above there is the need to develop the different colored images sequentially on the photoconductor and accordingly each successive color development step must happen with the presence of all prior color toner latent images on the photoconductor. The development step must proceed without any disturbance of these prior color toner images else the quality of the latent images will be affected. Additionally it is important that none of the prior toner layers be back developed into the developer housing of a different color or after a long period of time the colors will be altered. It is therefore important that the toner cloud not impress upon the photoconductor with excessive force or momentum that these non-interactive behaviors are observed. It has been found that by utilizing an asymmetric AC potential on the donor roll rather than a conventional symmetric AC that the effect of improved fine structure developability can be achieved simultaneous with a reduced interactivity performance. Hence the critical aspect of the donor voltage source is its asymmetry. Whether the underlying waveform to be skewed is a square wave or a sine wave is not important.

Metering blade 62 is positioned closely adjacent to magnetic roll 46 to maintain the compressed pile height of the developer material on magnetic roll 46 at the desired level. Magnetic roll 46 includes a non-magnetic tubular member or sleeve 52 made preferably from aluminum and having the exterior circumferential surface thereof roughened. An elongated multiple magnet is positioned interiorly of and spaced from the tubular member. Elongated magnet 56 is mounted on bearings and coupled to a motor. Tubular member 52 may also be mounted on suitable bearings and coupled to a motor.

Toner particles are attracted from the carrier granules on the magnetic roll to the donor roll. As successive electrostatic latent images are developed, the toner particles within the developer material are depleted. Augers 54 are mounted rotatably to mix fresh toner particles with the remaining developer material so that the resultant developer material therein is substantially uniform with the concentration of toner particles being optimized.

Figure 9:
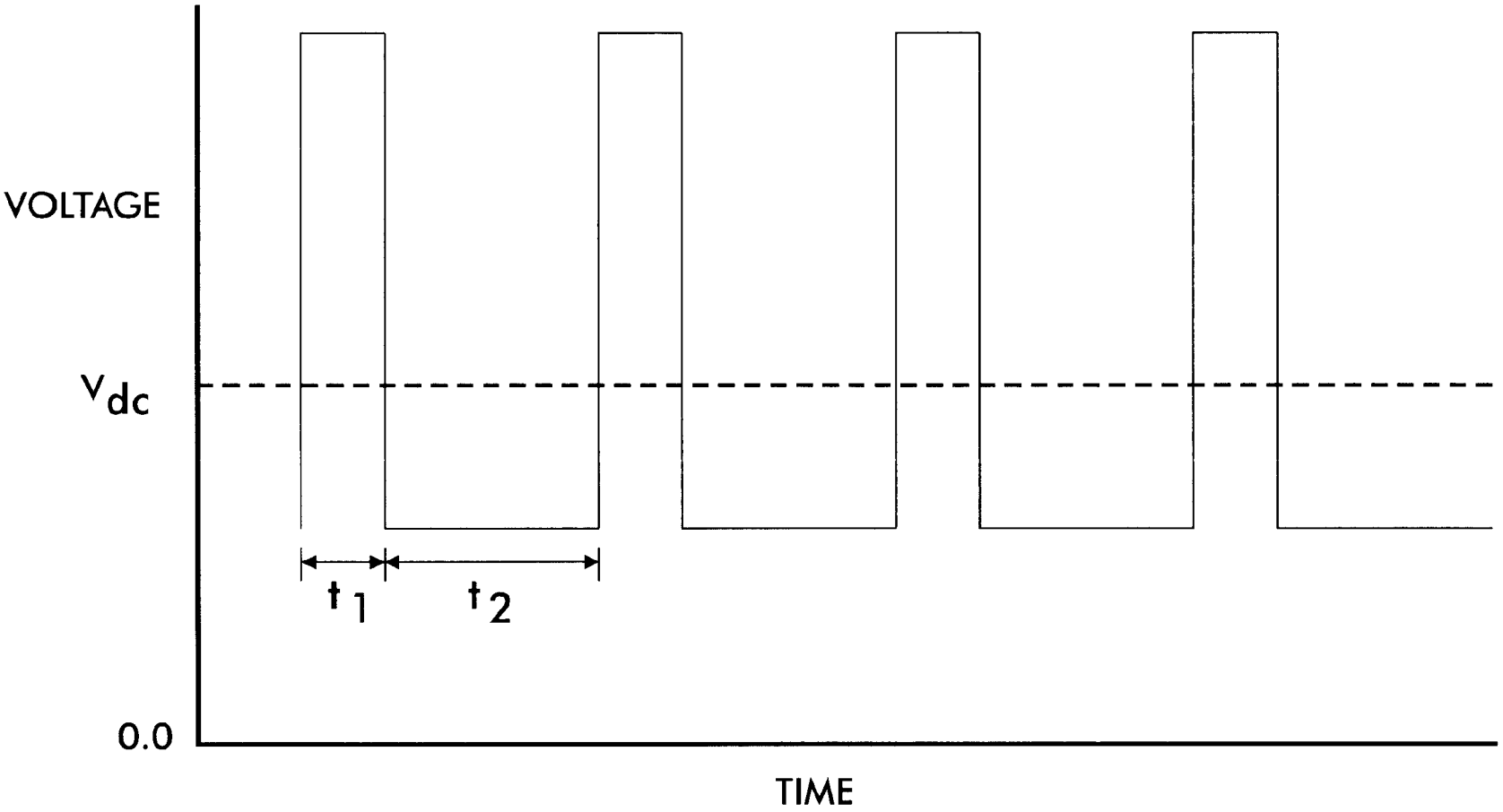
FIG. 9 is a graph of an exemplary asymmetric electrical waveform electrically biasing the donor roll of the FIG. 8 developer unit.

Referring now to FIG. 9, there is shown a graph of an exemplary asymmetric electrical waveform electrically biasing the donor roll of FIG. 8 developer units. It has been found experimentally that inducing a 30/70% duty cycle between $t_1$ and $t_2$ maintain the nominal developability of the symmetric 50/50% case but with much improved non-interactivity performance.

In recapitulation, it is evident that the development system of the present invention includes electrode wires positioned closely adjacent the exterior surface of a donor roll and in the gap defining the development zone between the donor roll and the photoconductive belt. After the toner particles are positioned on the donor roll, an asymmetrical electrical bias is applied to the donor rolls via an asymmetrical voltage source superimposed by a DC voltage source. It is, therefore, apparent that there has been provided in accordance with the present invention, a development system that fully satisfies the aims and advantages hereinbefore set forth.

While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

I claim:

1. An electrophotographic printing machine of the type in which an electrostatic latent image recorded on a charge retentive surface is developed with toner to form a visible image thereof, wherein the improvement includes: a donor roll arranged to transport toner to a development zone adjacent the surface; a plurality of electrode members disposed in the development zone; and means for electrically biasing said electrode members relative to said donor roll with a DC electric potential and an AC electrical wave form to detach toner from said donor roll and produce a toner cloud in the development zone, and means for electrically biasing the donor roll with an asymmetric electrical field to modify the position and attributes of said toner cloud.

2. A printing machine according to claim 1, wherein said electrical biasing means electrically biases said donor roll with a DC electrical potential and an asymmetrical AC electrical waveform.

3. A printing machine according to claim 2, wherein the asymmetrical AC electrical waveform is an asymmetrical square wave.

4. A printing machine according to claim 2, further including, a magnetic roll; and means for electrically biasing said magnetic roll with at least a DC electrical potential having a magnitude approximately equal to the magnitude of the DC electrical potential electrically biasing said electrode wires.

* * * * *